US007547273B2

(12) United States Patent
Haider

(10) Patent No.: US 7,547,273 B2
(45) Date of Patent: Jun. 16, 2009

(54) DRIVE DEVICE FOR SCREW CENTRIFUGES

(75) Inventor: Günter Haider, Vilsbiburg (DE)

(73) Assignee: Hiller GmbH, Vilsbiburg (DE)

( * ) Notice: Subject to any disclaimer, the term of this patent is extended or adjusted under 35 U.S.C. 154(b) by 404 days.

(21) Appl. No.: 11/182,553

(22) Filed: Jul. 15, 2005

(65) Prior Publication Data

US 2006/0014619 A1 Jan. 19, 2006

(30) Foreign Application Priority Data

Jul. 16, 2004 (DE) ..... 10 2004 034 409

(51) Int. Cl.
*B04B 9/02* (2006.01)
*B04B 1/20* (2006.01)

(52) U.S. Cl. ..... 494/84; 494/53

(58) Field of Classification Search ..... 494/7–9, 494/50–54, 84; 210/380.1, 380.3; 310/156.01, 310/156.08, 156.11
See application file for complete search history.

(56) References Cited

U.S. PATENT DOCUMENTS 3,343,786 A * 9/1967 Sharples ..... 494/51
5,714,858 A * 2/1998 Pieralisi ..... 494/84
5,941,810 A * 8/1999 Gay ..... 494/53
7,041,044 B2 * 5/2006 Gilbert ..... 494/53
7,358,635 B2 * 4/2008 Fout et al.
7,438,678 B2 * 10/2008 Beyer
2006/0014619 A1 * 1/2006 Haider ..... 494/53
2006/0183621 A1 * 8/2006 Beyer ..... 494/53
2008/0196890 A1 * 8/2008 Fout et al.

FOREIGN PATENT DOCUMENTS

DE 3325566 A1 * 1/1985

* cited by examiner

*Primary Examiner*—Charles E Cooley
(74) *Attorney, Agent, or Firm*—Cohen Pontani Lieberman & Pavane LLP

(57) ABSTRACT

A drive device for screw centrifuges has a rotating drum driven by a drum driving motor, and a screw mounted coaxially in the drum and having a screw shaft. A screw drive motor for rotating the screw has a housing rotatably fixed to the drum and an electric torque motor rotatably fixed to the screw shaft and disconnected from the drum driving motor.

8 Claims, 3 Drawing Sheets

DRIVE DEVICE FOR SCREW CENTRIFUGES

BACKGROUND OF THE INVENTION

1. Field of the Invention

The invention pertains to a drive device for screw centrifuges with a rotating, motorized drum and a screw.

2. Description of the Related Art

Various systems for driving screw centrifuges are known. The simplest drive is a gearbox drive, in which an electric motor drives the drum by a first V-belt, whereas a second V-belt, operating in parallel with the first, causes the screw to rotate by way of a planetary gear train. The planetary gear train is used to produce the speed differential for the screw. With this drive, the two rotational speeds can be varied independently of each other. For this purpose, the system must be stopped, and one of the two pairs of V-belts must be replaced.

Another concept is the so-called "hybrid" drive, in which an electric motor drives the drum via replaceable V-belts, whereas a hydraulic motor is provided to drive the screw. Thus the speed differential can be varied continuously while the system is running. The disadvantages of this system, however, are that it is difficult to control the speed differential at low speeds and that there is a large power loss at high speeds. It is also impossible to avoid leaks in a hydraulic drive, which is disadvantageous, especially, in the case of applications involving food products. Also, it is very expensive to manufacture and to maintain this type of drive.

Finally, there is another drive possibility, namely, the so-called "four-shaft" drive with two electric motors. This drive occupies a large amount of space, however, and frequently causes problems with respect to the sealing of the four shafts.

The objective of the invention is to provide a drive device for screw centrifuges in which the speed differential between the drum and the screw can be varied continuously during operation without above-discussed disadvantages of the hybrid drive and the four-shaft drive.

SUMMARY OF THE INVENTION

This task is accomplished according to the invention with a drive device of the basic type described briefly above and comprising an electric torque motor, which is disconnected from the motor which drives the drum, and has its housing connected to the drum and rotating along with it.

A drive device of this type consumes very little energy and offers optimal efficiency. It is characterized by high flexibility with respect to the choice of operating speeds while having a compact structure. Because the electric torque motor which is disconnected from the drum drive motor rotates along with the drum, the drive device is highly compact. Furthermore, since there is no hydraulic motor for the screw drive, there is no risk of leakage, which is particularly important in the food product area.

One possibility of realizing the invention consists in flanging the housing to a radial flange of a hollow shaft, which is permanently connected to the drum. The shaft of the screw extends through this hollow shaft, which also carries a V-belt pulley connected to the motor that drives the drum.

Alternatively, the housing can be flanged to an end wall of the drum and carry a V-belt pulley connected to the motor which drives the drum.

The electric torque motor operates like a normal, multipolar synchronous motor, the rotor of which is equipped with permanent magnets on its cylindrical inside surface, whereas the stator, located internally, caries the coils which are supplied with 3-phase current. As a result of this design principle, the motor takes up very little space. This space, in turn, is utilized very efficiently with respect to the amount of torque the motor produces.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The above and other advantages and features of the invention can be derived from the claims and from the following description of exemplary embodiments, which are illustrated in the drawing; wherein like reference numerals delineate similar elements through the several views:

DETAILED DESCRIPTION OF THE PRESENTLY PREFERRED EMBODIMENTS

Figure 1:
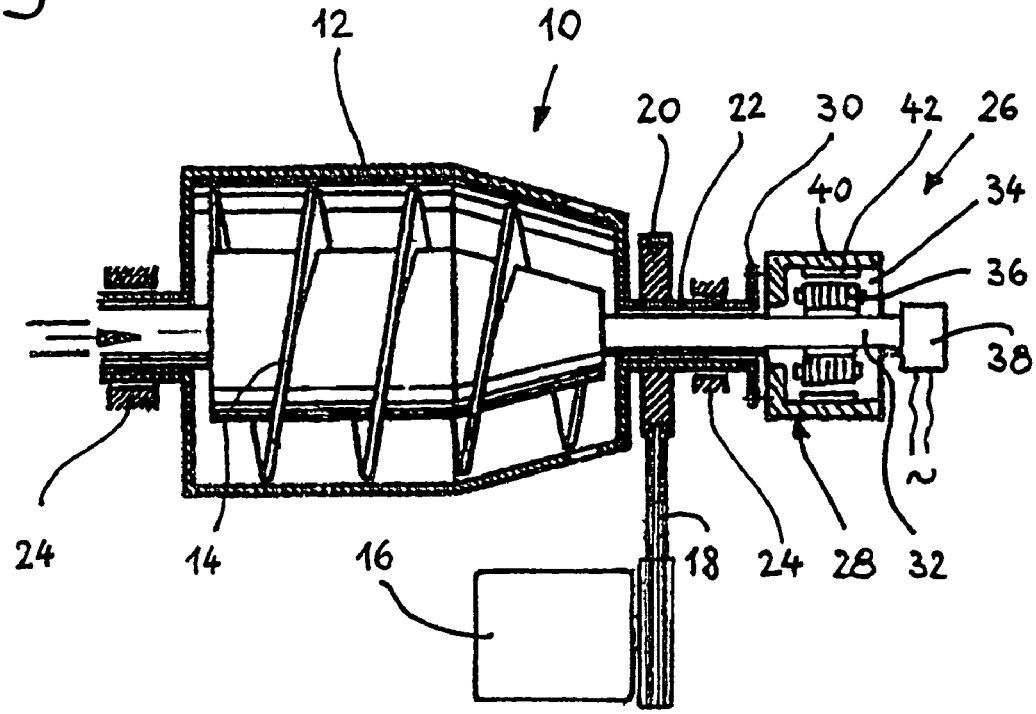
FIG. 1 shows a schematic cross-sectional diagram of a drive device for a screw centrifuge according to the invention.

FIG. 1 shows a longitudinal cross section through a screw centrifuge 10 with a rotating drum 12, in which a screw 14 is supported. The drum 12 is rotated by an electric motor 16, which sets a V-belt pulley 20 in rotation by way of V-belts 18. The pulley is pushed onto a hollow shaft 22, which is permanently connected to the drum 12. The drum 12 is supported rotatably at the ends in bearings 24 in the standard manner.

A multipolar torque motor 26 is used to rotate the screw 14. The housing 28 of the motor is permanently connected to the drum 12 by way of a flange 30 of the hollow shaft 22. The shaft 32 of the screw 14 passes through the hollow shaft 22. The stator 34 of the torque motor 26 carries a plurality of coils 36, which are supplied with cuffent by way of a slip-ring induction motor 38, and is pushed onto the shaft 32 of the screw 14.

The housing 28 of the torque motor 26 is designed as an external rotor 40, the cylindrical inside surface of which is equipped with permanent magnets 42, which are adhesively bonded to the inside surface.

The drive motor 16 causes rotation of v-belt pulley 20 via v-belt 18. Rotation of the v-belt pulley 20 causes rotation of the hollow shaft 22, thereby causing rotation of the drum 12 which is permanently connected to the hollow shaft 22. Rotation of the hollow shaft 22 also causes rotation of the housing 28, which is connected to the hollow shaft by the flange 30. Accordingly, the drive motor 16 causes each of the hollow shaft 22, the drum 12, and the housing 28 to rotate.

Rotation of the stator 34 of the torque motor 26 causes rotation of shaft 32 and screw 14.

Figure 2:
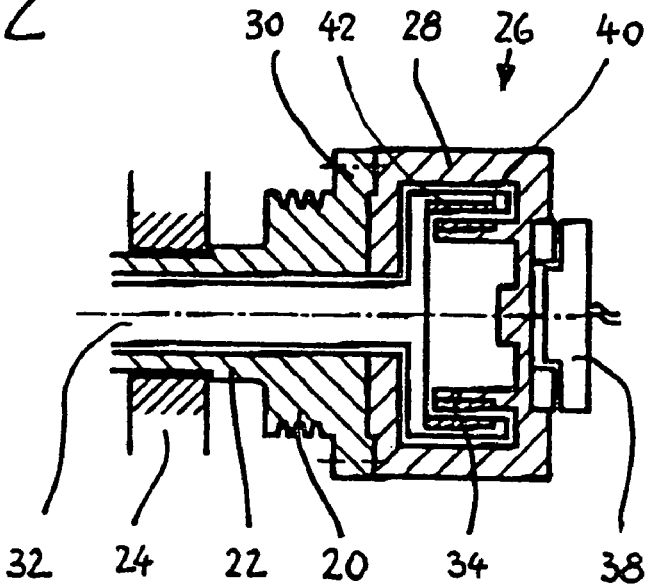
FIG. 2 shows a diagram of part of a variant of the device according to FIG. 1.

In the variant shown in FIG. 2, the rotor 40 of the torque motor 26 is permanently connected to the shaft 32 of the screw 14 and carries on its cylindrical inside surface the previously mentioned permanent magnets 42. The stator 34 carrying the coils 36 is permanently connected here to the housing 28 of the torque motor 26. Here, too, the slip-ring induction motor 38 serves to supply current to the coils 36 of the stator 34, which fits axially into the cup-shaped rotor 40.

The hollow shaft 22 for the rotary drive of the drum 12 is designed as an integral part of the V-belt pulley 20, located between the bearing 24 and the flange 30, to which the housing 28 of the torque motor 26 is attached. As shown in the example of FIG. 1, the pulley is connected to the motor 16 which drives the drum 12 and the housing 28 by way of V-belts 18. Rotation of the rotor 40 of the torque motor 26 relative to the housing 28 causes rotation of the shaft 32 and the screw 14.

Figure 3:
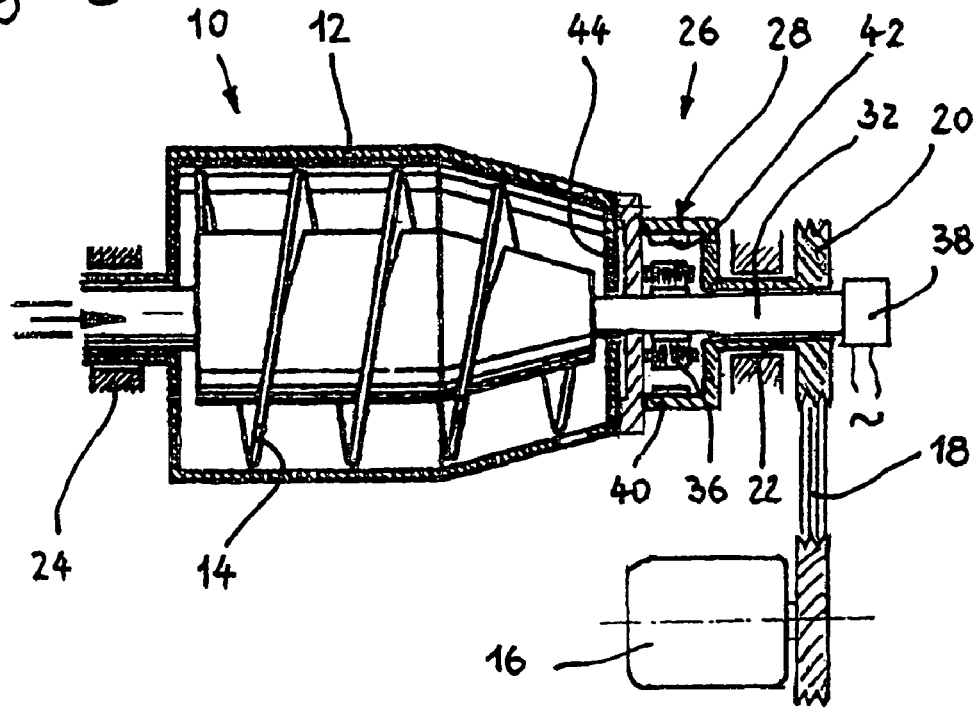
FIG. 3 shows a longitudinal cross section through another variant of the device according to FIG. 1.

The exemplary embodiment shown in FIG. 3 represents another variant, in which the housing 28 of the torque motor 26 is flanged to an end wall 44 of the drum 12. The housing 28 merges here into the hollow shaft 22, which is mounted rotatably in the bearing 24. The end of the shaft which faces the slip-ring induction motor 38 carries the V-belt pulley 20, which is connected by V-belts 18 to the motor 16, which drives the drum 12. In this exemplary embodiment, too, the cylindrical inside surface of the rotor 40 formed by the housing 28 is equipped with permanent magnets 42, whereas the coils 36 are pushed onto the shaft 32 by which the screw 14 is driven.

In the embodiment of FIG. 3, the drive motor 16 causes rotation of v-belt pulley 20 via v-belt 18. Rotation of the v-belt pulley 20 causes rotation of the hollow shaft 22, thereby causing rotation of the housing 28 which is permanently connected to the hollow shaft 22. Rotation of the hollow shaft 22 also causes rotation of the drum 12, which is connected to the housing 28 by the end wall 44. Accordingly, the drive motor 16 causes each of the hollow shaft 22, the drum 12, and the housing 28 to rotate.

As in the previous embodiments, rotation of the coils 36 of stator 34 of the torque motor 26 causes rotation of shaft 32 and screw 14.

Figure 4:
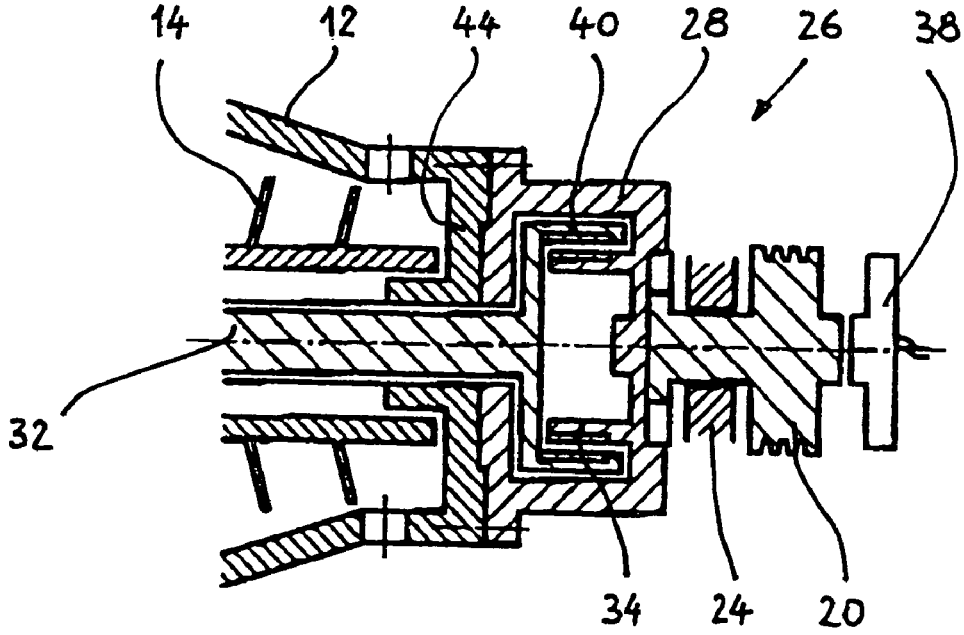
FIG. 4 shows an enlarged diagram of yet another possible design variant.

FIG. 4 represents a variant of FIG. 3 and shows a design principle similar to that of the embodiment according to FIG. 2. Here, too, there is a torque motor 26, the housing 28 of which is attached to the end wall 44 of the drum 12. As in the example of FIG. 2, the rotor 40 of the torque motor 26 is again permanently connected to the shaft 32 of the screw 14, whereas the internal stator 34 is a part of the housing 28. As in the previous embodiments, rotation of the motor 16 causes rotation of the v-belt pulley 20, thereby causing rotation of the housing 28 and drum 12. Rotation of the rotor 40 of the torque motor 26 relative to the housing 28 causes rotation of the shaft 32 and the screw 14.

Figure 5:
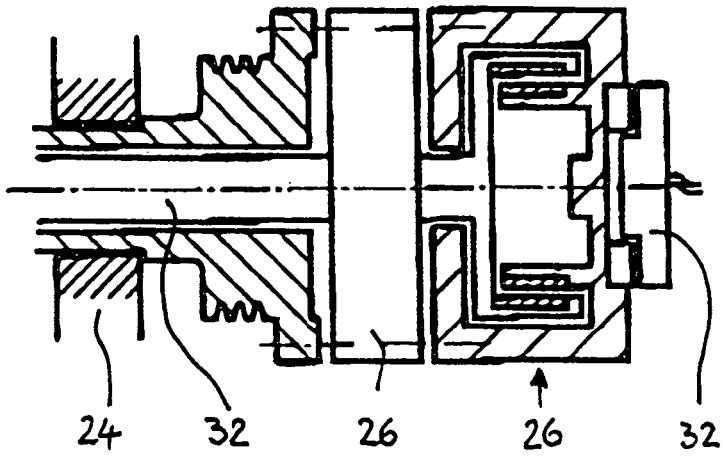
FIG. 5 shows a schematic diagram of the use of several torque motors.

FIG. 5 points out the possibility that several torque motors 26 can be connected in series to drive the drum 12. In this embodiment, the drive motor 16 rotates the housing of torque motor 26 and the drum in a manner similar to that described with respect to the embodiment of FIG. 3. The torque motors 26 of FIG. 5 are each similar to the torque motor depicted in FIGS. 2 and 4. The housings of each of the torque motors 26 are fixed to and rotate with the pulley. The rotors of the torque motors rotate to cause rotation of the shaft 32 and screw 14.

Figure 6:
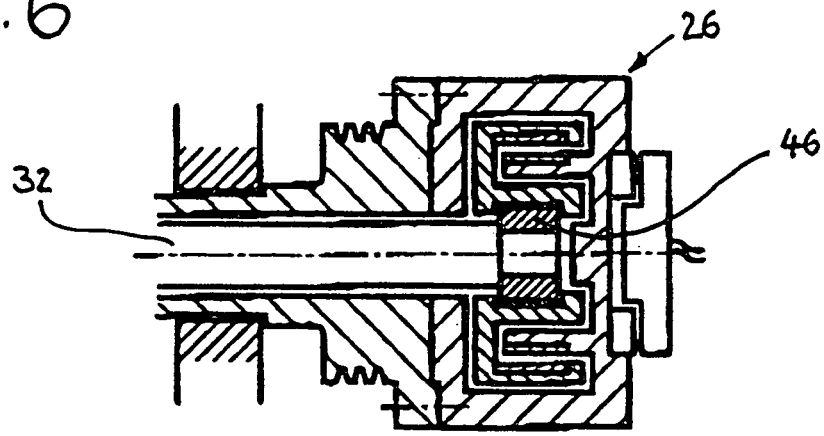
FIG. 6 shows a possible use of a torque motor with a gear train.

FIG. 6 shows that the torque motor 26 can be connected to the shaft 32 which drives the screw 14 by a single-stage or multi-stage gear train 46. In this embodiment, the housing and drum are rotated in a manner similar to that described with respect to the embodiment of FIG. 3. The rotation of the rotor of the torque motor 26 rotates the shaft 32 via the single-stage or multi-stage gear train 46.

Figure 7:
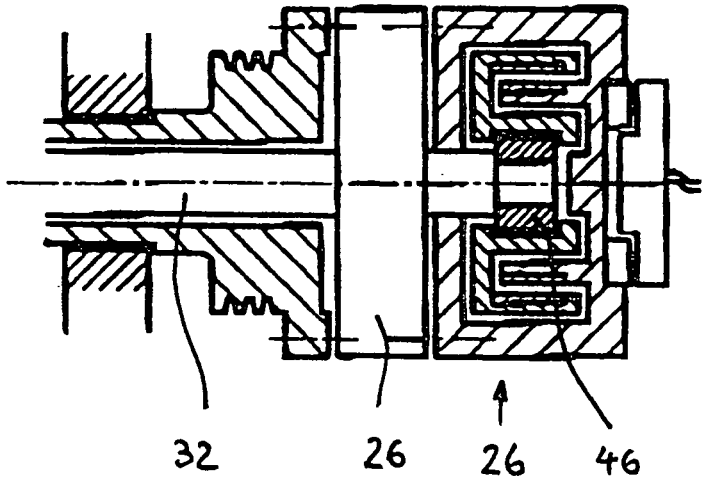
FIG. 7 shows a combination of the possibilities shown in FIGS. 5 and 6.

FIG. 7 shows the combination of the possibilities shown in FIGS. 5 and 6 with several torque motors 26 and an internal gear train 46. In this embodiment, the housing and drum are rotated in a manner similar to that described with respect to the embodiment of FIG. 3. In this case, the torque motors 26 operate similarly to the torque motors of FIGS. 2 and 4. Rotation of the rotors of the torque motors 26 in FIG. 5 causes rotation of shaft 32 via the single- stage or multi-stage gear train It is obvious that the invention also comprises the use of torque motors in which the stator carries the permanent magnets and the rotor carries the coils.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A drive device for a screw centrifuge, the screw centrifuge comprising a drum and a screw mounted in the drum and extending coaxially therewith, the drive device comprising:

a drum driving motor coupled to the drum so as to actuate the drum; and a screw driving motor comprising:

a housing permanently fixed to the drum so as to rotate therewith, and a torque motor mounted in the housing and rotatably coupled to the screw, wherein the housing of the torque motor is an external rotor and has an inner cylindrical surface supporting a plurality of permanent magnets, the torque motor having a stator carrying a plurality of coils and mounted on and rotatably fixed to a screw shaft, whereas the screw shaft is rotatably fixed to the screw, wherein the torque and drum driving motors are disconnected from one another.

2. The drive device of claim 1, further comprising a hollow shaft flanged to the housing and permanently connected to the drum, further comprising:

a screw shaft rotatably fixed to the screw and to the housing of the torque motor, the screw shaft extending through the hollow shaft and being coaxial therewith; and a V-belt pulley fixed to the hollow shaft and to the drum driving motor.

3. The drive device of claim 2, wherein the hollow shaft has a radial flange coupled to the housing of the torque motor.

4. The drive device of claim 1, further comprising a V-belt pulley coupled to the housing of the torque motor and to the drum driving motor, the drum having an end wall flanged to the housing of the torque motor.

5. The device of claim 1, further comprising at least one additional torque motor coupled in series with the torque motor.

6. The device of claim 1, further comprising a single-stage gear train rotatably coupling the screw and the torque motor.

7. The device of claim 1, further comprising a gear train rotatably coupling the screw and the torque motor.

8. A drive device for a screw centrifuge, the screw centrifuge comprising a drum and a screw mounted in the drum and extending coaxially therewith, the drive device comprising:

a drum driving motor coupled to the drum so as to actuate the drum: and a screw driving motor comprising;

a housing permanently fixed to the drum so as to rotate therewith, and a torque motor mounted in the housing and rotatably coupled to the screw, wherein the screw has a screw shaft, the torque motor having a rotor fixed to the screw shaft and a stator fixed to the housing of the torque motor, wherein the rotor of the torque motor has a cylindrical inner carrying a plurality of permanent magnets, the stator of the torque motor carrying a plurality of coils, and wherein the torque and drum driving motors are disconnected from one another.

* * * * *